United States Patent [19]

Klemm

[11] Patent Number: 4,589,336

[45] Date of Patent: May 20, 1986

[54] SCREEN PRINTING METHOD AND APPARATUS

[76] Inventor: Gerhard Klemm, Im Rehwinkel 37, D 4800 Bielefeld 1, Fed. Rep. of Germany

[21] Appl. No.: 520,442

[22] Filed: Aug. 2, 1983

Related U.S. Application Data

[63] Continuation-in-part of Ser. No. 202,052, Oct. 30, 1980, abandoned.

[30] Foreign Application Priority Data

Oct. 31, 1979 [DE] Fed. Rep. of Germany ..... 2943893

[51] Int. Cl.[4] ..... B41L 13/18

[52] U.S. Cl. ..... 101/124; 101/123

[58] Field of Search ..... 101/124, 123, 126

[56] References Cited

U.S. PATENT DOCUMENTS

| | | | |
|---|---|---|---|
| 1,922,710 | 8/1933 | Owens | 101/123 |
| 2,039,909 | 5/1936 | Kem | 101/123 |
| 2,581,775 | 1/1952 | Wade | 101/123 |
| 2,864,308 | 12/1958 | Luppold | 101/124 |
| 3,237,555 | 3/1966 | Jones | 101/124 |
| 3,673,954 | 7/1972 | Lala | 101/124 |
| 3,780,652 | 12/1973 | Black | 101/124 |
| 3,885,493 | 5/1975 | Jaffa | 101/124 |
| 3,945,317 | 3/1976 | Brasa | 101/124 |
| 4,372,203 | 2/1983 | Brasa | 101/124 |
| 4,376,412 | 3/1983 | Nagatani | 101/124 |

*Primary Examiner*—Clyde I. Coughenour

*Attorney, Agent, or Firm*—Peter K. Kontler

[57] ABSTRACT

A screen printing machine has a reciprocable printing screen and below it a counter-pressure roller. Above the screen a squeegee unit is movable relative to the screen and has two vertically displaceable parallel squeegees. During movement of the screen in one direction, one of the squeegees forces ink through the screen and the other squeegee is retracted. During reverse movement the one squeegee is retracted and the other one pushes the ink pool over the screen back to the starting position. In the starting position, the one squeegee is lowered again and the other squeegee is retracted. The transfer of the ink pool from the other squeegee to the one squeegee takes place directly above the printing line which is defined by the screen in conjunction with the counter-pressure roller. The screen printing machine is provided with a control device for coordinating the movements of the squeegee unit with the movements of the printing screen.

14 Claims, 11 Drawing Figures

SCREEN PRINTING METHOD AND APPARATUS

CROSS-REFERENCE TO A RELATED APPLICATION

This application is a continuation-in-part of application Ser. No. 202,052 filed Oct. 30, 1980 abandoned.

BACKGROUND OF THE INVENTION

The present invention relates to screen printing.

More particularly, the invention relates to an improved screen printing method and to apparatus for carrying this method into effect.

It is known to screen print with the aid of a flat stencil or printing screen which is arranged above the workpiece to be printed (e.g. a sheet material). A counter-pressure roller supports the printing screen (and the subjacent workpiece) from below, and a pair of squeegees are arranged above the screen and squeegee printing ink through the screen. A machine of this type is disclosed in U.S. Pat. No. 3,120,180 for printing onto discrete sheets of paper or the like. It is not suitable for printing onto continuous workpiece webs since the color interspaces between the pattern repeats must be very long, due to the fact that the dual squeegee device is stationary and is associated with the counter-pressure roller in such a manner that the squeegee which effects printing is located permanently directly above the upper apex line of the counter-pressure roller. The distance between the printing squeegee and the drag squeegee determines the spacing between the pattern repeats. It is evident that large distances between pattern repeats are a disadvantage where the printing of continuous webs is concerned since the web material which remains unprinted between the pattern repeats must be discarded as scrap.

OBJECTS AND SUMMARY OF THE INVENTION

An object of the invention is to provide an improved dual-squeegee screen printing machine.

Another object of the invention is to provide a dual-squeegee screen printing machine which, when used for discontinuous printing of workpiece webs, is capable of printing with close pattern repeats, i.e. wherein the spaces between successive repeats are small.

One feature of the invention resides in the provision of a screen printing machine with means for screen printing webs which pass between a printing screen and a counter-pressure roller, with the aid of a squeegee unit having two parallel squeegees which can be individually raised and lowered. Another feature of the invention resides in the provision of a method including the steps of moving the printing screen in one direction over the counterpressure roller while lowering one and raising the other squeegee, so that a pool of printing ink on the screen is pushed ahead of the one squeegee from a starting position and some of the ink is forced through the screen along a printing line defined with the counter-pressure roller; reversing the direction of screen movement while raising the one and lowering the other squeegee so that the pool of ink is pushed by the other squeegee back to the starting position while maintaining the one squeegee above the printing line; at least towards the end of the movement in reverse shifting the one squeegee away from its position over the printing line, so that the other squeegee can push the pool of ink to a position above the printing line; and retracting the other squeegee while lowering the one squeegee and substantially simultaneously shifting it back to a position above the printing line.

The novel features which are considered as characteristic for the invention are set forth in particular in the appended claims. The machine itself, however, both as to its construction and its mode of operation, together with additional features and advantages thereof, will be best understood from the following description of specific embodiments when read in connection with the accompanying drawing.

BRIEF DESCRIPTION OF THE DRAWING

FIGS. 4 through 11 show diagrammatic views of another embodiment of the invention, of which FIGS. 4 and 5 show the position of the screen printing machine at the onset of a printing operation, FIGS. 6 and 7 show the position of the machine at the start of return movement when the drag squeegee is applied to the pool of ink, FIGS. 8 and 9 show the position of the machine at the end of the movement of the drag squeegee, and FIGS. 10 and 11 show that position of the machine when the printing squeegee is applied to the pool of ink during the return movement of the screen and the squeegee unit up to the point when the printing squeegee is lowered and comes to the position shown in FIG. 4.

DESCRIPTION OF PREFERRED EMBODIMENTS

Figure 1:
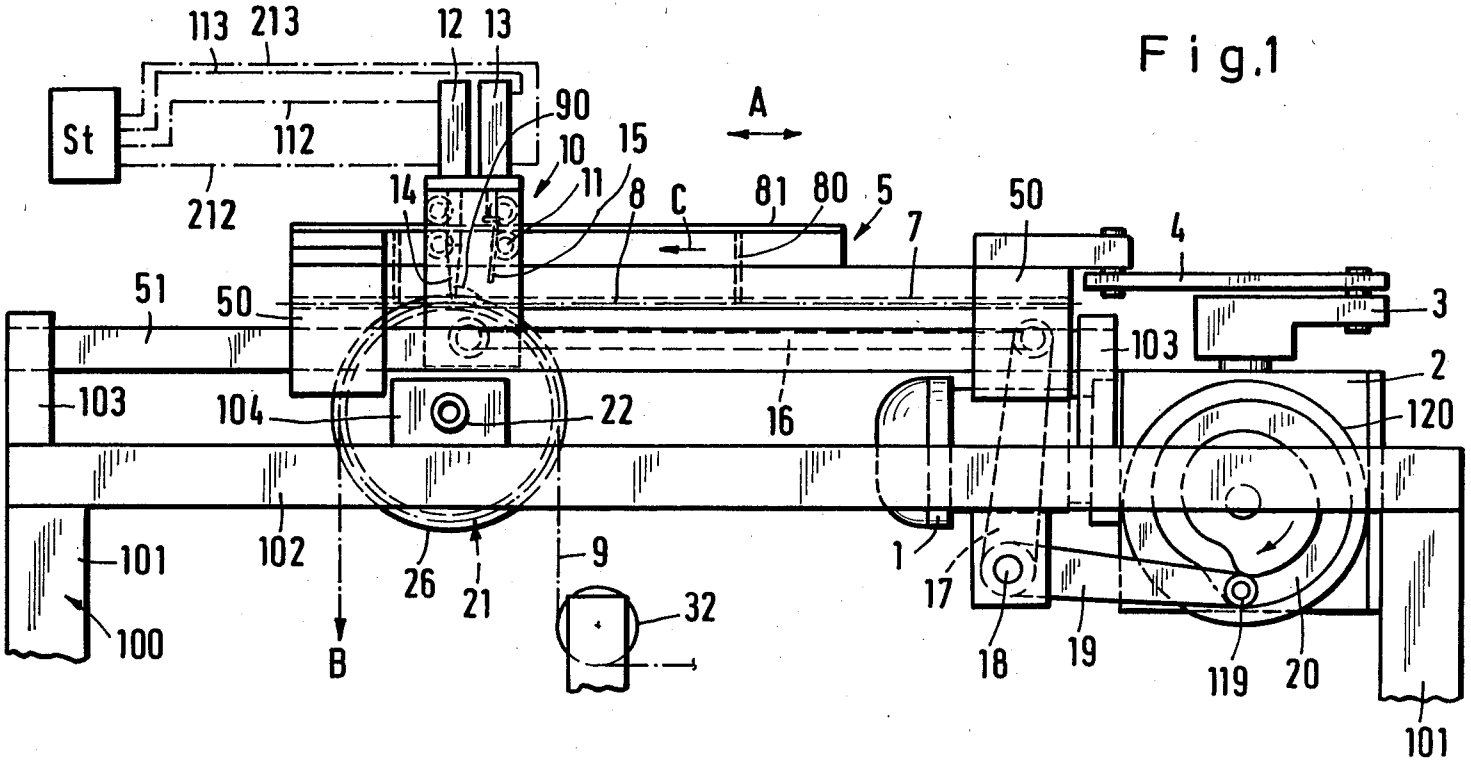
FIG. 1 is a somewhat diagrammatic side elevational view of a screen printing machine embodying one form of the invention, shown at the onset of a printing operation.
Figure 2:
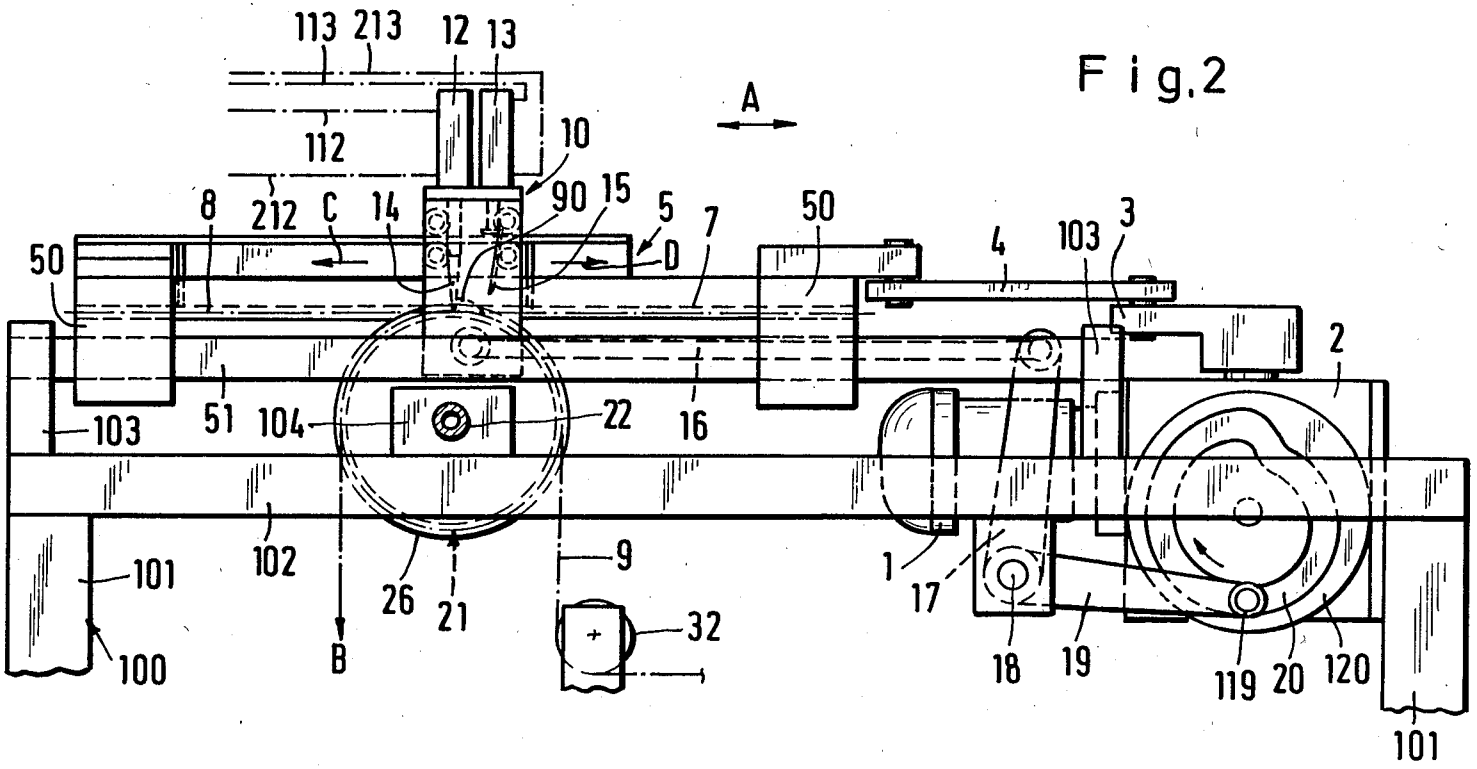
FIG. 2 is the same view as in FIG. 1, but showing the machine shortly before completion of the printing operation.
Figure 3:
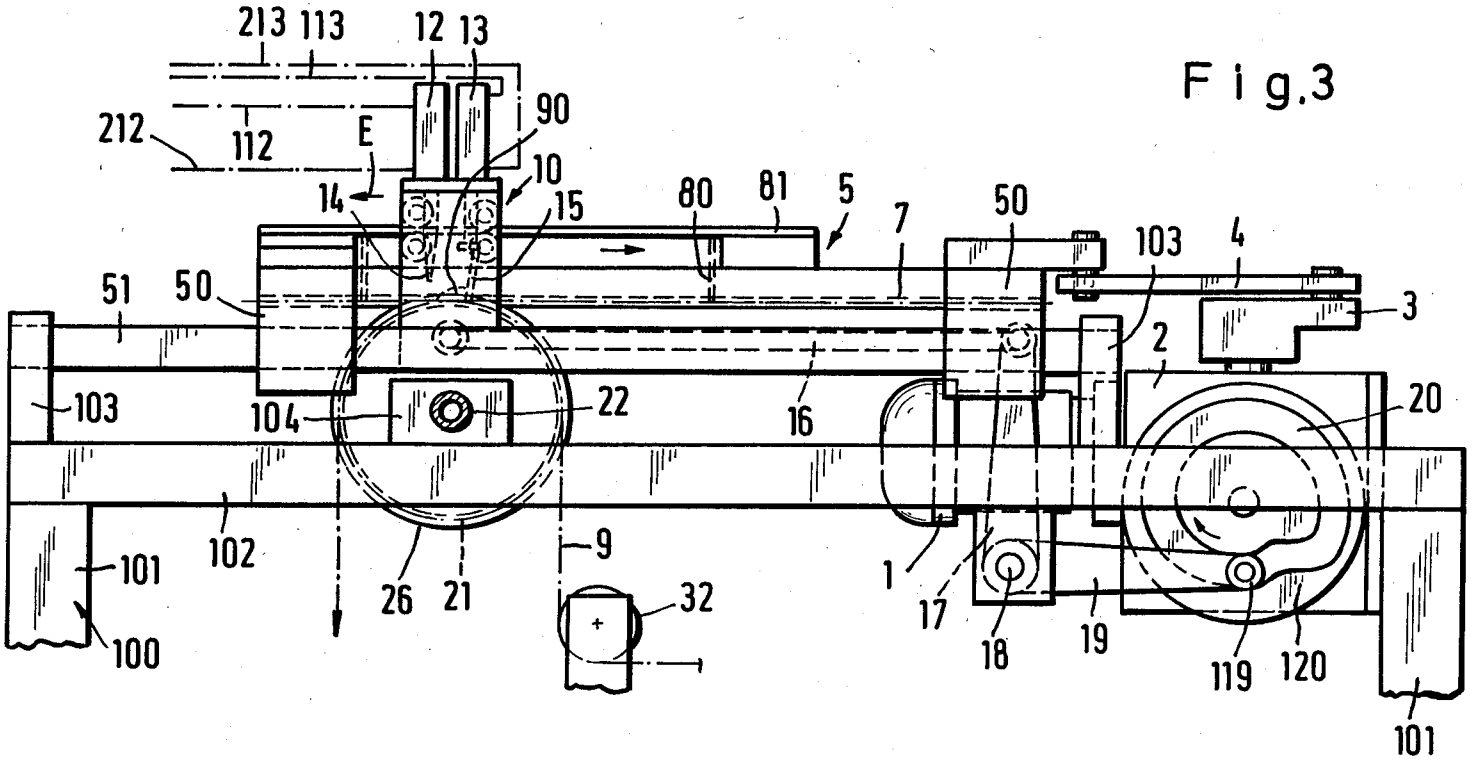
FIG. 3 is again the same view as in FIGS. 1 and 2, but showing the machine just about to start the next printing operation.

Since FIGS. 1–3 all show the same machine, albeit in different operation phases, they will be jointly dexcribed.

The main machine device is designated by the reference numeral 1 and drives a transmission 2 which imparts a reciprocating movement to a screen carriage 5 via a crank 3 and a link 4. Mounted in the interior of carriage 5 is a screen frame 80 which carries a flat screen or stencil 8 of rectangular or square shape. Guide bars 51 or analogous elements extend lengthwise of the direction of reciprocation and four journals 50 of the carriage 5 are slidably guided pairwise on the bars 51, so that the carriage can reciprocate in the directions of the double-headed arrow A. The pivot connections between crank 3 and link 4 are adjustable (known per se) so that the extent of reciprocatory movement can be varied.

The carriage 5 is either provided with a rack 7, or one of its longitudinal frame members is formed as such a rack. In either case, however, the rack 7 meshes with a gear 26 of a counter-pressure roller 21 which is of cylindrical shape and engages the workpiece web 9 to be printed, from below. The roller 21 extends over the entire width of the web 9 and is preferably constructed as a suction or vacuum roller (known per se). The gear 26 is adjacent that axial end of the roller 21 which faces the viewer of FIGS. 1–3, but could be located elsewhere.

A deflecting roller 32 deflects the web 9 towards the roller 21 about which it is trained. At the apex of the roller 21 the web is printed and then run off the roller 21 in any desired direction, as symbolized by the arrow B. It is advantageous if the web 9 moves from a pay-out roll to a take-up roll, and a drying station may be interposed between the roller 21 and the take-up roll so that the print on the web is dried before the web is taken up.

The carriage 5 has lateral, longitudinally extending rails 81 on which a squeegee unit 10 is guided. For this purpose the unit 10 has at each lateral side four rollers 11 of which two engage the corresponding rail 81 from above and two from below, each upper roller 11 being vertically aligned with a lower roller. The squeegee unit 10 is thus movable in the same direction, indicated by arrow A, as the carriage 5 but can do so independently of the carriage.

Mounted in the unit 10 are two squeegees, a printing squeegee 14 and a drag squeegee 15. They are in the form of e.g. blades of e.g. natural or synthetic rubber or other synthetic plastic material (being elongated at right angles to the planes of the Figures) and their upper ends are mounted on cylinder and piston units 12, 13, respectively, which constitute means for displacing the squeegees toward and away from the upper side of the screen 8. A control device ST (known per se) is connected with the cylinder and piston unit 12 via conduits 112 and 212; the unit 13 is similarly controlled by the device ST via conduits 113 and 213. The device ST may constitute a multi-way control valve which is actuated in response to signals received from limit switches which sense the reciprocating movements of the carriage 5 and unit 10. If desired, the control device ST can be omitted and the control can be effected directly via signals from the limit switches. The incremental advance of the workpiece web 9 can also be controlled by the device ST, if desired.

The unit 10 is provided with its own drive or shifting means, so that the position of the squeegees 14, 15 can be changed with reference to the printing line (i.e. the apex line on roller 21). In the illustrated embodiment this drive is a push rod 16 which is articulately connected to the unit 10 at 16*a* and to a lever 17 at 16*b*. The lever 17 is mounted on a shaft 18 for turning movement with the same; an arm 19 is connected to the shaft 18 in the same manner and has a free end portion on which a freely turnable roller follower 119 is mounted. The follower 119 tracks a cam groove 20 (or the periphery of a cam) on a disk 120 which is rotated in the direction of the arrow by the transmission 2.

All of the heretofore described components are mounted on a frame 100 having uprights 101, longitudinal frame members 102 and supports 103 for the guide bars 51. The transmission 2 is mounted on one or more of the uprights 101 and the prime mover 1 (e.g. an electric motor) is mounted on the transmission. It goes without saying that the frame components, transmission and prime mover are stationary, together with a journal 104 for the shaft 22 of roller 21.

The illustrated arrangement prints upon the web 9 during movement of the carriage 5 in the direction of the arrow C in FIG. 1 (i.e. from right to left), during which the unit 10 and the roller 21 are so positioned relative to one another (in vertical direction) that the lower edge of the printing squeegee 14 is located on the printing line (apex) of the circumference of the roller 21 so that the pool 90 of ink (paste) is "pushed" ahead of the squeegee 14 when the carriage 5 moves. FIG. 1 shows that stage during which the squeegee 14 has just moved into the position in which it can "push" the pool 90 in this manner and in which movement of the carriage 5 to the left has just begun. This position is maintained due to movement of the follower 119 along the concentric part of cam track 20, and as a result the unit 10 remains at a standstill during this stage, with the squeegee 14 located precisely above the printing line on roller 21; only the carriage 5 is moved by the crank 3 and link 4.

FIG. 2 shows the end position of carriage 5, in which the ink pool 90 has been pushed farthest to the right by the squeegee 14. In preparation for the next printing operation the pool 90 must now be returned to the leftmost position which it had assumed in FIG. 1. For this purpose the printing squeegee 14 is raised by operation of its cylinder and piston unit 12 and the drag squeegee 15 lowered by operation of its cylinder and piston unit 13. Movement of the carriage 5 in the direction of the arrow C is completed and return movement now begins in the direction of arrow D, due to a pull being exerted upon the carriage 5 by the crank 3 via link 4.

During this return movement the squeegee 15 drags the ink pool 90 towards the left. The web 9, which moved with the carriage in the direction of arrow C, now stands still, as does the roller 21 due to the fact that the gear 26 is provided with a free-wheeling device (known per se) so that it is not entrained by the rack 7 during this stage. Since the screen 8 is tensioned and the squeegee 15 is lowered only so far that it exerts no pressure on the screen (and hence does not force ink through the openings of the screen), no printing takes place as the pool 90 is dragged back towards the left.

During the stage of movement which is illustrated in FIG. 2, the follower 119 begins to reach a part of the cam track 20 which is no longer concentric with the axis of rotation of the cam 120 but which instead begins to approach this axis. As a result, there will be a slight shifting away of the unit 10 (and of the squeegee 14) from the previous position precisely above the printing line as the movement of the carriage 5 in the direction of the arrow D proceeds. Due to the fact that the squeegee 14 is raised, this shift has no influence at this stage of the operation, except for the fact that the squeegee 15 is displaced closer towards the printing line.

The end of the movement in direction D, i.e. of the drag movement, is shown in FIG. 3. At this stage the follower 119 is just about to enter the pronounced dip in the cam track 20; when this occurs the unit 10 performs a small movement in the direction of arrow E but immediately thereafter reverses itself and assumes a position in which the squeegee 14 is located directly above the printing line on roller 21. During this reversal the cylinder and piston unit 12 lowers the squeegee 14 into engagement with the screen 8 and at the same time the unit 13 raises the squeegee 15. The ink pool 90 is now again located ahead of the printing squeegee 14 as shown in FIG. 1, and the device is ready for the next printing operation.

It is clear that the step from FIG. 3 to FIG. 1 is very short, just long enough for the follower 119 to pass through the short inward dip of the cam track 20 until it reaches the beginning of the concentric part (FIG. 1) of the cam track. It is due to this brief retraction movement that the pool 90 is engaged from behind by squeegee 14 and pushed to the center line (i.e. above the printing line), as shown in FIG. 1.

Various modifications may be made without departing in any way from the spirit of the invention. For example, the roller 21 and unit 10 could be made to move jointly (or in a predetermined relationship to one another) in a direction counter to that of the movement of carriage 5, to reduce the stroke length and thus the interval between successive printing operations. The controls and drives would then have to be somewhat more complicated than in the illustrated embodiment. Also, the squeegees 14, 15 could be raised and lowered by means other than the illustrated cylinder and piston units; for example, electromagnets and restoring springs might be used. The squeegees 14, 15 could also be individually mounted for their movements, rather than being part of a movable unit 10.

What counts is that the ink pool which is dragged along by the drag squeegee 15 is reliably engaged from behind by the printing squeegee 14 so that even during the movement of the printing squeegee to its printing (lowered) position the pool of ink is made ready to act as the printing pool, while the drag squeegee is retracted. The transfer of the ink pool from the drag squeegee to the printing squeegee takes place not downstream of the printing line (i.e. to the right thereof in FIGS. 1–3) but directly above or even slightly upstream of the printing line (to the left thereof in FIGS. 1–3).

The just described embodiment, although susceptible of a variety of modifications, has been found to be particularly simple, sturdy and inexpensive. It is simple to operate, nearly maintenance-free and highly reliable in operation.

FIGS. 4 through 11 illustrate another embodiment of the invention in various stages of operation. It should be noted that only those portions of the machine which are different from those shown in FIGS. 1–3 are shown in FIGS. 4 to 11. Those components of the screen printing machine which are not shown FIGS. 4 to 11 are similar to the components depicted in FIGS. 1–3.

With reference to FIGS. 4–11 it will be seen that the main machine drive 1 similarly to that of FIGS. 1–3 imparts through transmission 2 and crank 3 a pivoting movement to the link 4. The screen carriage 5 of FIGS. 1–3 is omitted in this embodiment. A screen device 88 is pivotally connected to one end of the link 4 so that a reciprocating movement is imparted to the screen frame 80 from the main drive and the crank arrangement. The screen frame 80 carries the screen 8 having in the middle thereof a permeable area which is known per se.

The screen frame 80 is guided by the rails 81 which can be formed of profile iron. The screen frame 80 can be guided on the rollers or be provided with any other suitable conventional follower means.

Above the screen frame 80 is mounted a support 100′ which carries the squeegee unit 110 and the discrete drive for the squeegee unit. This drive for moving the squeegee unit back and forth in the directions of arrow A of FIG. 3 may comprise piston-cylinder units 116 each of which has a piston rod 16′. Each piston-cylinder unit 116 is rigidly secured to support 100′ and is used in place of the push rod 16 of the embodiment of FIGS. 1–3.

The whole squeegee unit 110 is moved back and forth in the directions of arrow A due to the movement of the pistons of the units 116. This movement is so coordinated that it can be performed independently from the movement of the screen frame.

In order to ensure the operation of the squeegee unit 110 and the application of the printing squeegee 14 and drag squeegee 15 to the pool 90 of ink the squeegee unit 110 is provided with a cylinder-piston unit 123 which is supported on a squeegee carriage 200 which can be provided with suitable rollers for movement along a guide rail 82. The guide rails 81 and 82 are parallel to each other so that the screen device and the squeegee unit can be guided parallel to each other.

It is possible, by means of a pivoting or swinging mechanism, to adjust the squeegee unit 110 with the single cylinder 123 so that either the printing squeegee 14 or the drag squeegee 15 would be positioned above the screen or the printing squeegee would be pushed down to a level so low that it would be in contact with the counter-pressure roller 21 which is preferably formed as a vacuum roller.

Figure 4:
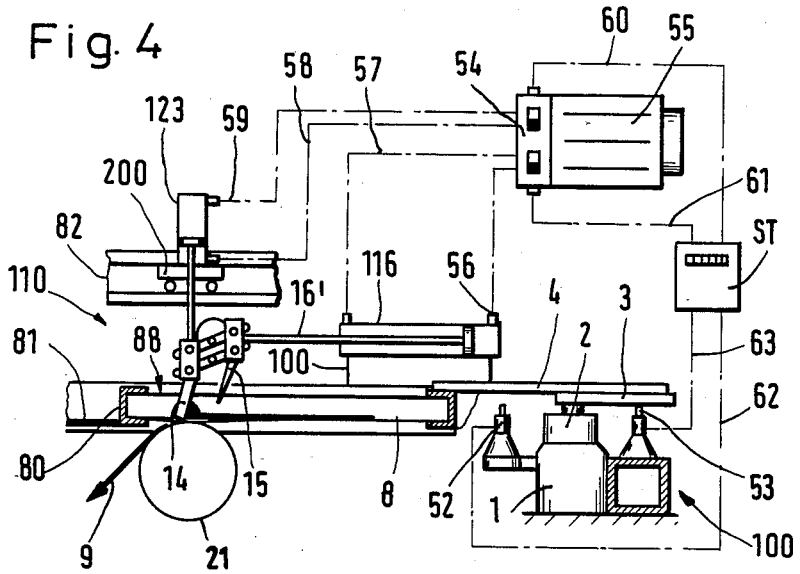
Figure 5:
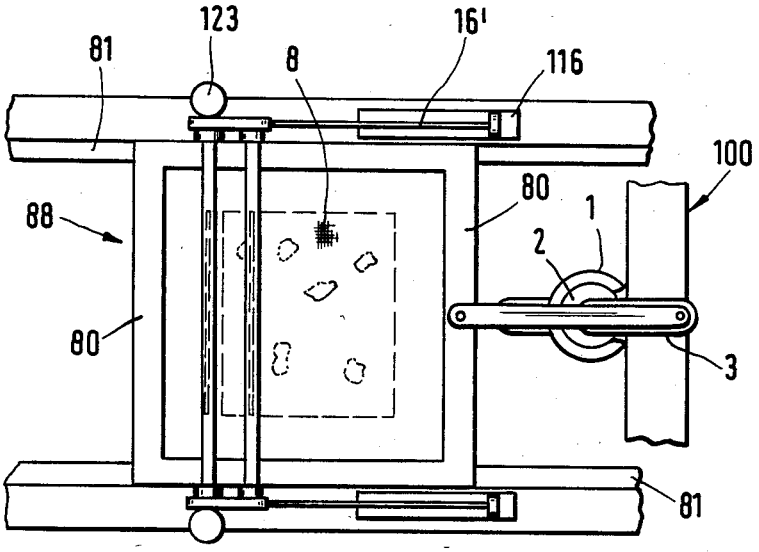

The coordination of the individual components of the device can be seen from FIG. 4. The control unit St (known per se) in this embodiment is connected to two switches 52, 53 via electric conductors 62, 63; switches 52, 53 come into contact with the crank 3 depending on its position. The control unit St coordinates the movements of the squeegee unit 110 and the screen device 88. Unit St is further connected to a control valve unit 54 which is provided with a pressure air generator 25.

Switches 52 and 53 are actuated by crank 3 selectively, depending on the position of crank 3. Signals from the switches 52 and 53 are transmitted to the control valve unit 54 because the control unit St actuates the control valve unit which, as was mentioned above is coupled to the compressor 55.

The compressor 55 may be of any known construction. Compressed air which is supplied by the compressor 55 is fed through conduits 56, 57 to cylinder-piston units 116 and via conduits 58, 59 to the piston-cylinder unit 123. The control valve unit 54 can comprise two slide valves and can be constructed in such a way that pressure is either present in one of the pair of conduits or this pressure is shut off. It is to be realized that the control valve of another kind can be utilized for control of relative movements of the components of the machine.

It is also possible to obtain the coordination of the above movements by simpler means. For example, if the crank 3 runs over the switch 52 to switch over the movement from the position shown in FIGS. 4 and 5 to the position illustrated in FIGS. 6 and 7, e.g. for performing and ending the printing stroke, the conduit 59 contains pressurized air whereby the printing squeegee is lowered and firmly presses the screen 8 against the roller 21. The conduit 57 also contains compressed air to lock the squeegee unit 110 in the printing position unless the crank 3 is pivoted through 180° and assumes the position shown in FIGS. 6 and 7. The crank 3 runs over the switch 52 and a backward movement play occurs as shown in FIGS. 8 through 11. The control unit in these figures is shown only partially; for example, the conduits 56, 57, 58 and 59 and the electrical conductors 62, 63 are not illustrated.

Figure 6:
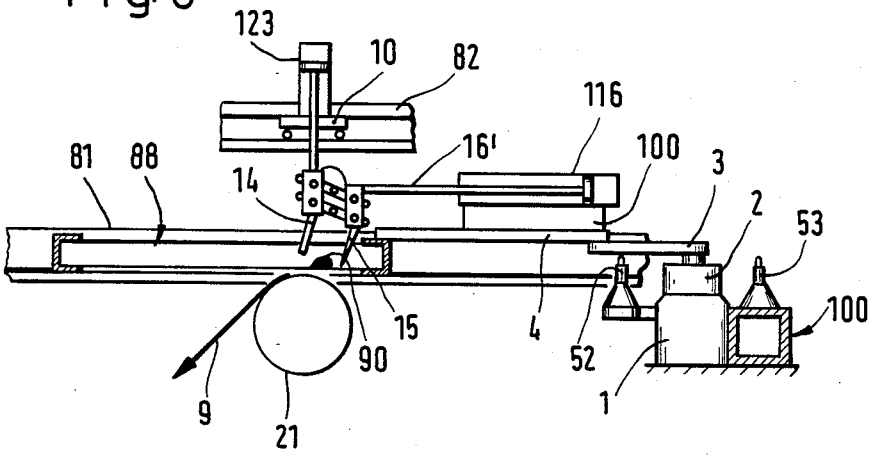
Figure 7:
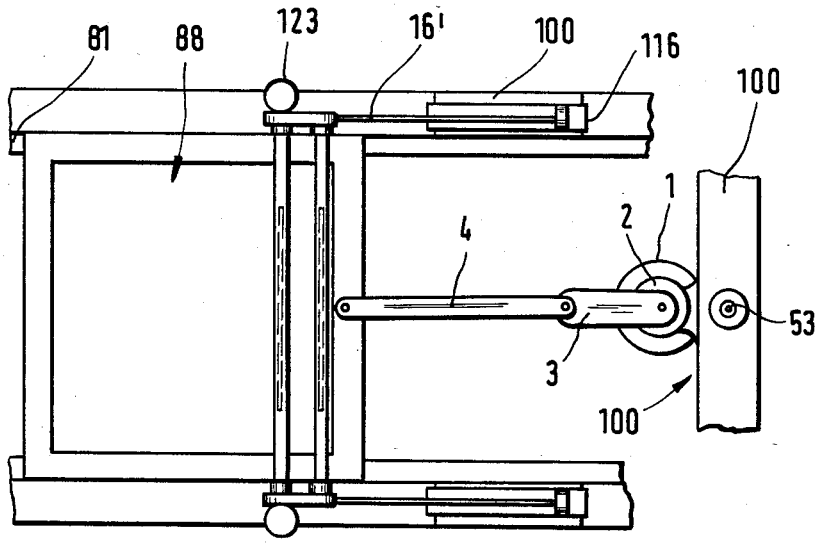
Figure 8:
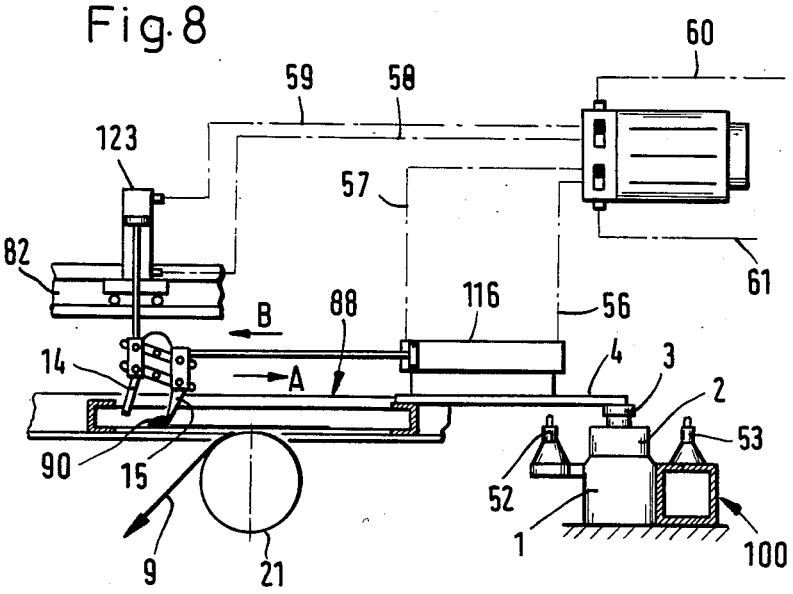
Figure 9:
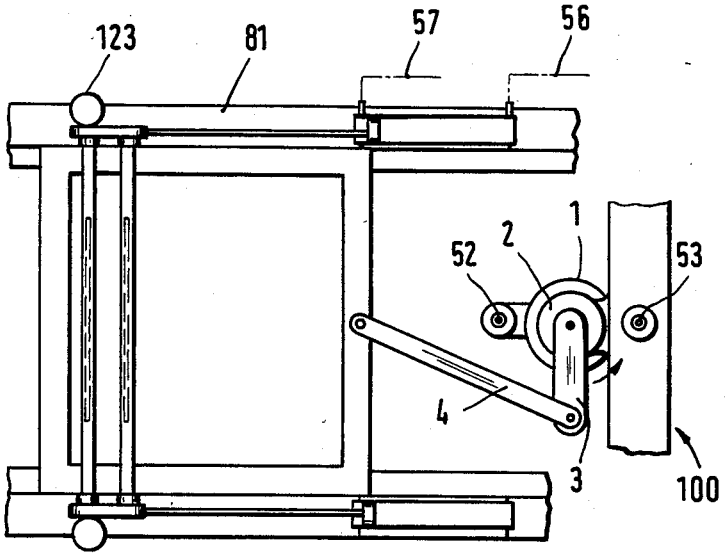
Figure 10:
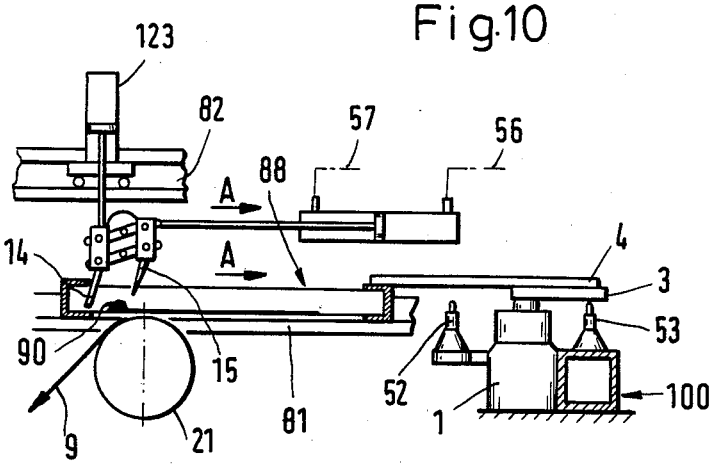
Figure 11:
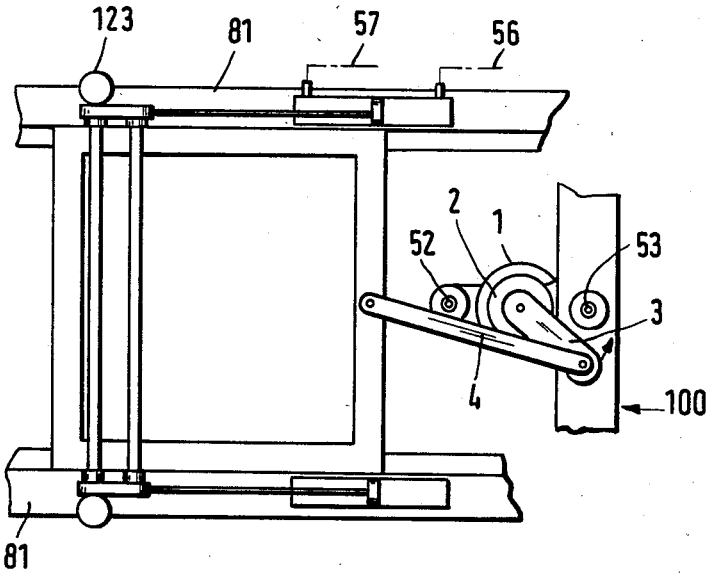

FIGS. 8 and 9 show the last stage of movement of the drag squeegee, the beginning of which is shown in FIGS. 6 and 7. Upon the switching over of the switch 52, compressed air is admitted into the cylinders of the units 116 and 123. The conduits 56 and 58 then contain compressed air whereby the drag squeegee 15 is lowered and the printing squeegee 14 is raised as shown in FIG. 6 and the pool 90 of ink engaged by the drag squeegee from behind is dragged over the entire length of the screen until the printing squeegee faces the pool of ink at the opposite end of the screen frame 80 as shown FIG. 8. The pool 90 of ink is displaced beyond the apex of the counter pressure roller 21 further to the end of the screen frame 80 when the return movement of the screen has already taken place and the device is again switched over the screen moving backward in the direction of arrow A' whereby the printing squeegee is lowered befor it assumes the position above the apex of the counter-pressure roller 21 as shown in FIG 10. The printing squeegee is caused to assume the suitable printing to be positioned against the screen which is not yet located in the upper surface of the counter-pressure roller 21 but remeans in an intermediate position for a fraction of a second and the screen device 88 together with the squeegee unit 110 is moved in the direction of arrow A'.

During that stage of movement which is shown in FIGS. 8 and 9 a counter running can be seen, this counter running occurring between the movement of the screen device 88 in the direction of arrow A' and the feeding of the squeegee unit as a whole to the end of the screen device in the direction of arrow B'. As can be seen in FIG. 8 the end position of the squeegees is several mm short of the end of the screen frame whereas in FIG. 10 the printing squeegee 14 reaches the end of the screen frame and thereafter the return movement of the whole device in the direction of arrow A' takes place. The valving elements of the control valve unit 54 should be individually actuated so that they would not abruptly switch the device over but would rather provide, first a slow control of the squeegee unit relative to the screen frame and then the common reverse control.

The essential advantage of the overrunning of the whole squeegee unit over the center line of the counter-pressure roller 21 is that due to precise control of the device, pressure is applied to the device exactly.

In particular, it is possible to apply a new pressure change of several mm to the previous pressure already prevailing in the conduits of the device so that contact of the squeegee unit with the counter-pressure roller first occurs via control of the printing squeegee in the downward direction and the screen is then maintained in the predetermined dead center position above the apex of the counter-pressure roller until such time when the squeegee unit is loosened from the rear portion of the screen frame and is moved backward. In order to understand the above one should compare the positions of the parts of the machine in FIGS. 4 and 10.

The coordination of the movement of the squeegee unit and the screen frame is obtained by the control unit St which is also electrically connected with the drive motor of the counter-pressure roller 21.

While the invention has been illustrated and described as embodied in a flat-stencil screen-printing machine, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

I claim:

1. In a screen printing machine, a combination comprising (1) a substantially flat printing screen having a first side arranged to be contacted by a pool of a printing medium and a second side;

(2) a counter-pressure roller located at the second side of said printing screen and defining with the second side of said printing screen a printing line;

(3) means for reciprocating said printing screen in predetermined directions relative to said counter-pressure roller between spaced-apart first and second positions;

(4) a squeegee unit disposed at said first side of said printing screen and including (4a) a printing squeegee and a drag squeegee, (4b) means for positioning said printing squeegee to force the printing medium of said pool through said printing screen in the region of said printing line and against a running workpiece web, which overlies said counter-pressure roller, while said screen moves from said first to said second position, (4c) means for selectively displacing said squeegees toward and away from said first side of the printing screen so that said printing squeegee is disengaged from the printing screen upon completion of movement of said printing screen from said first to said second position, so that said drag squeegee is moved into contact with the screen during the initial stage of movement of said screen to said first position and so that said printing squeegee reengages the screen not later than at the time said screen starts to move from said first position back toward said second position with said flood squeegee disengaged from said screen;

(4d) means for shifting said squeegee unit in said predetermined directions independently of said printing screen, said shifting means moving said squeegees as a unit counter to the direction of movement of said screen as the screen returns to the first position so that said drag squeegee shifts the pool relative to said print line followed by shifting said squeegees in the direction of movement of said screen toward said second position for positioning the printing squeegee for another printing on said workpiece web; and (5) guide means for said squeegee unit.

2. The combination of claim 1, wherein said squeegee unit comprises a carriage on which said squeegees are mounted and further comprising a screen support, said guide means including rails extending in said directions and said carriage including means for tracking said rails, said rails being provided on said screen support.

3. A combination as defined in claim 1, wherein said shifting means includes a rotary cam having a cam track including an arcuate first portion with a center of curvature on the axis of the cam, a second portion which gradually approaches said axis, and a third portion dipping steeply towards said axis and having, as considered in the direction of rotation of said cam, a leading end merging into said first portion and a trailing end merging into said second portion.

4. A combination as defined in claim 3, wherein said shifting means further includes a shaft, a pusher having a first portion articulately connected to said squeegee unit, a lever having a first portion articulately connected to a second portion of said pusher and a second portion fixedly connected to said shaft and an arm having a first portion fixedly mounted on said shaft and a second portion provided with a follower tracking said cam.

5. A combination as defined in claim 1, further comprising a prime mover and a transmission driven by said prime mover and arranged to transmit motion to said reciprocating means and said shifting means.

6. A combination as defined in claim 1, wherein said displacing means comprises a pair of fluid operated cylinder and piston units each connected with one of said squeegees, and control means connected to said units for operating the same.

7. A combination as defined in claim 1, further comprising means for advancing the workpiece web to said counter-pressure roller so that the web is trained over a portion of the web.

8. A combination as defined in claim 7, wherein the workpiece web contacts said counter-pressure roller along an arc of substantially 180°.

9. A combination as defined in claim 1, wherein said reciprocating means comprises a carriage having a toothed rack extending in said directions and further comprising a gear coaxial with said roller and meshing with said rack and a free-wheeling device mounting said gear for rotation with said roller in one direction and for angular movement relative to said roller in the opposite direction.

10. A combination as defined in claim 1, wherein said counter-pressure roller is a hollow suction roller having a circumferential wall provided with openings, and further comprising a device for sucking air into said roller by way of said openings.

11. A combination as defined in claim 1, wherein said shifting means includes a cylinder-piston unit.

12. A combination as defined in claim 1, further including coordinating means for synchronizing the movements of said printing screen with the movements of said squeegee unit in said directions.

13. A combination as defined in claim 12, wherein said coordinating means includes a control unit which is electrically connected with said reciprocating means and a control valve unit connected to said control unit, to said shifting means and to said displacing means.

14. A method of screen printing workpiece webs in a machine wherein one side of a flat printing screen is contacted by a pool of a printing medium and a counter-pressure roller is located at the other side of and defines with the screen a printing line, wherein a workpiece web is trained over the counter-pressure roller, wherein the screen is reciprocable in predetermined directions between first and second positions and wherein a squeegee unit is shiftably guided for movement in said directions independently of the screen and has printing and drag squeegees which are selectively displaceable toward and away from the one side of the screen, comprising the steps of (a) moving the screen from the first to the second position;

(b) simultaneously maintaining the printing squeegee in contact with the one side of the screen so that the printing squeegee forces the printing medium of the pool through the screen and into contact with the workpiece web in the region of the printing line;

(c) disengaging the printing squeegee from the one side of the screen when the screen reaches the second position;

(d) moving the screen from the second back toward the first position;

(e) moving the drag squeegee into contact with the one side of the screen; and (f) moving the squeegees as a unit first counter to the direction of movement of the screen toward the first position so that the drag squeegee shifts the pool with reference to the printing line and thereupon in the direction of the second position for positioning the printing squeegee for another printing on said workpiece web.

* * * * *